United States Patent [19]

Coy

[11] Patent Number: 4,517,427

[45] Date of Patent: May 14, 1985

[54] FREQUENCY RESONANCE HEATER

[75] Inventor: Charles H. Coy, Springport, Ind.

[73] Assignees: Richard H. Williams, Muncie; Marion L. DeBolt; Daniel C. Burry, both of Decatur, all of Ind.

[21] Appl. No.: 505,482

[22] Filed: Jun. 17, 1983

[51] Int. Cl.[3] ..... H05B 5/00

[52] U.S. Cl. ..... 219/10.51; 219/341; 219/10.49 R; 219/10.65

[58] Field of Search ..... 219/10.51, 10.49 R, 219/10.55 R, 10.55 A, 10.81, 10.65, 341

[56] References Cited

U.S. PATENT DOCUMENTS

| | | | |
|---|---|---|---|
| 3,641,302 | 2/1972 | Sargeant | 219/10.51 X |
| 3,980,855 | 9/1976 | Boudouris et al. | 219/10.55 X |
| 4,124,794 | 11/1978 | Eder | 219/341 |

*Primary Examiner*—Roy N. Envall, Jr.
*Assistant Examiner*—Marvin M. Lateef
*Attorney, Agent, or Firm*—Harvey B. Jacobson

[57] ABSTRACT

An AC voltage is applied to feeder end points of an electrode assembly enclosed within a body of liquid through which current is conducted to generate heat. The current path has a minimum effective length of a quarter wave antenna of the single wire dipole type from which electromagnetic wave energy is radiated at a radio frequency that is a harmonic of the alternating frequency of the AC voltage applied.

20 Claims, 5 Drawing Figures

Fig. 1
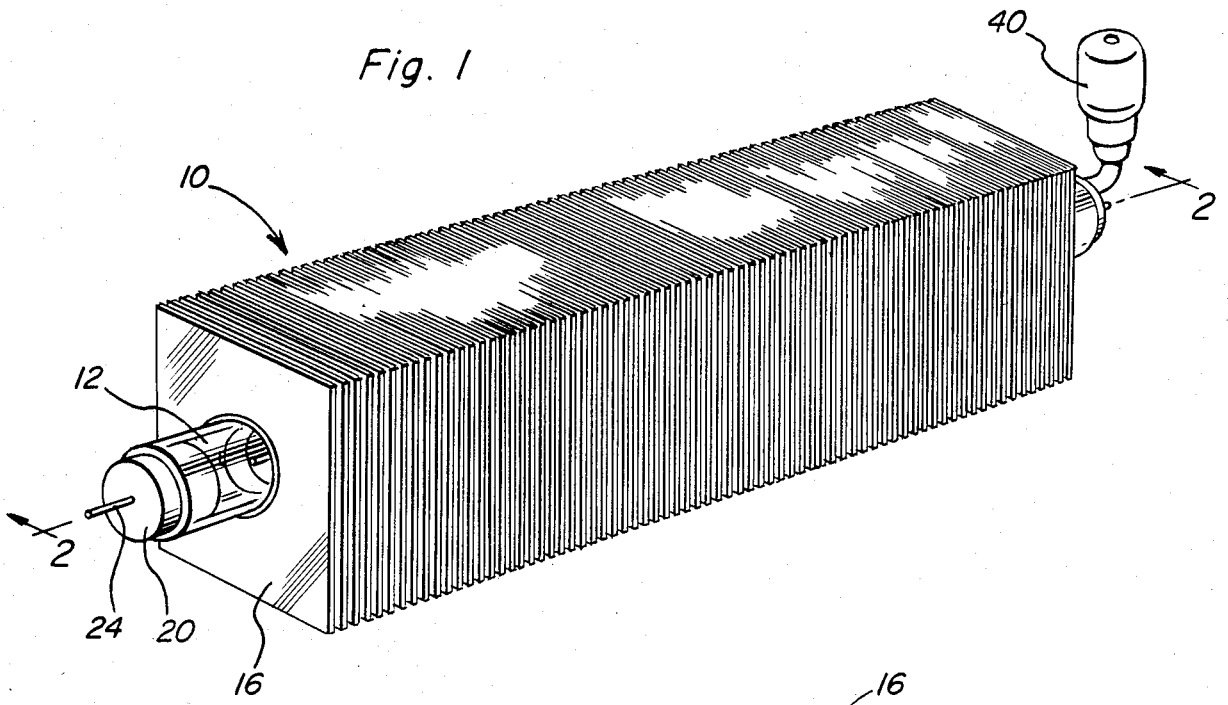
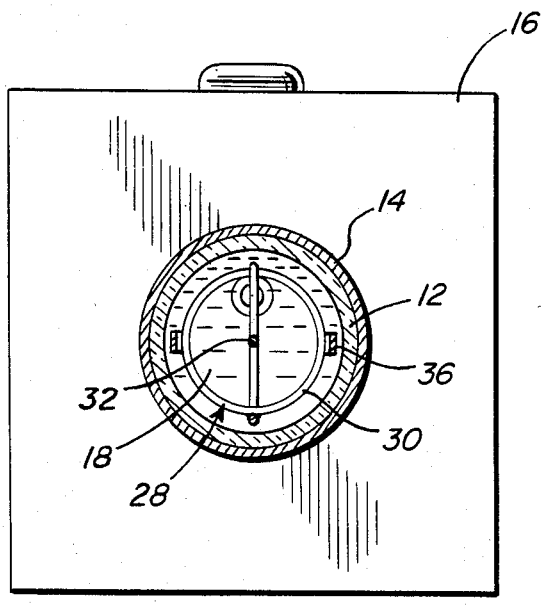
Fig. 4
Fig. 5
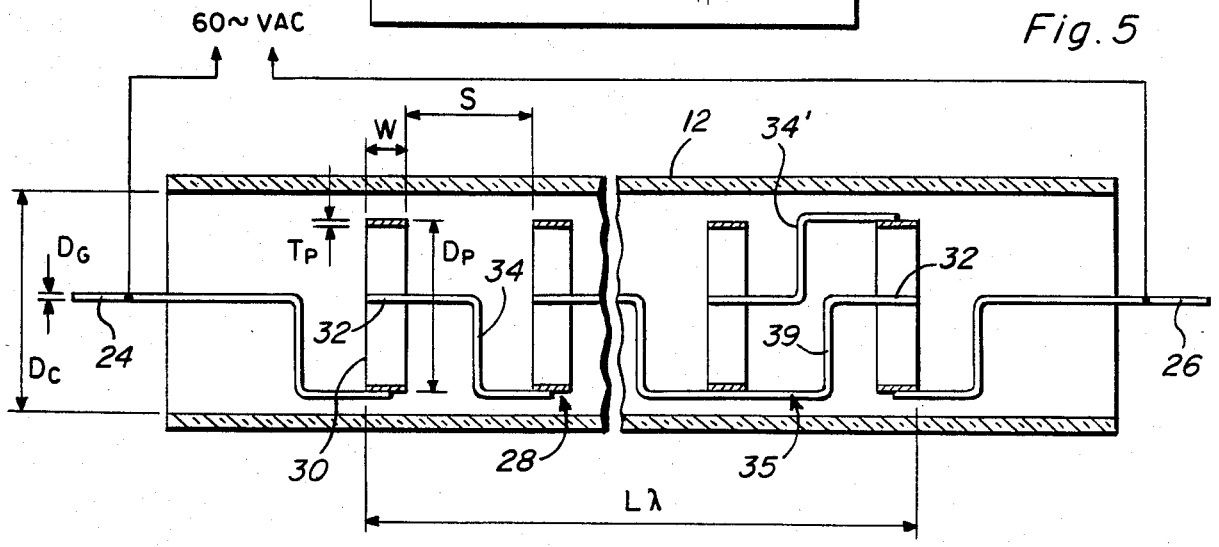

FREQUENCY RESONANCE HEATER

BACKGROUND OF THE INVENTION

This invention relates in general to electrical space heaters.

Generally, electrical heaters for enclosed spaces in buildings or the like, employing standard resistance heating elements, as referred to for example in U.S. Pat. No. 4,012,794 to Eder, conducting electrical current through a ceramic coated, continuous wire coil to generate heat. The heat is radiated from the coil assembly by heat conductive fins. Such heaters draw relatively high current and operate at relatively high temperatures in order to effectively radiate heat to a relatively large air space. For example, a commercially available baseboard heater operated at 120 VAC having an overall length of 14 inches consumes 4.17 amperes, reaches a temperature of 390° F. with a substantially constant ohmic resistance.

Apparatus utilizing a high frequency generator as a source of energy is also known for treating liquid as disclosed for example in U.S. Pat. No. 3,641,302 to Sargent and for induction heating purposes. Such apparatus are not suitable for space heating purposes and are not economically feasible in connection therewith.

It is therefore an important object of the present invention to provide an economical heater of the electrical type which will be more effective in radiating heat in response to current flow through a conductive medium supplied directly from available power sources.

SUMMARY OF THE INVENTION

It is a major discovery of the present invention that heat may be effectively generated within and radiated from a confined body of liquid by passage of current, alternating at a low pulsating frequency such as 60 cycles per second, through the liquid along a path between electrodes establishing a resonance relationship between the alternating current frequency through the dimensions of the current path corresponding to that of a single wire dipole antenna dimensionally tuned to radiate electromagnetic wave energy at a high frequency that is a harmonic of the low alternating current frequency of the voltage applied to feeder end points of the electrode assembly. For design of a basic minimum dimension heater in accordance with one embodiment of the invention, a fundamental radio frequency of 223.5 MHz was selected to establish a frequency pass band for harmonics of a 60 cycle AC voltage source, on which basis a minimum quarter wave dipole antenna length of approximately 12 inches was calculated as the theoretical resonance length of the liquid current path of the heater. The current path length is however reduced by a small amount to compensate for end effects at the feeder end points.

In accordance with one embodiment of the invention, the electrode assembly is provided with a plurality of series connected, electrode element pairs through which the current path is established connected to end feeder leads through an antenna matching balun. Dimensioning of the electrodes, depends therefore on the calculatred length of the current path as aforementioned, the number of electrode pairs selected, and the liquid selected. Actual tests performed on such an arrangement utilizing water as the liquid revealed that the liquid rises in temperature to a maximum operating level approaching the boiling point of 212° F. during a start-up period with a corresponding decrease in its ohmic resistance to a relatively constant value. Heat generated in the body of water was radiated externally to the air space being heated through heat conductive fins at a rate which compares favorably with that of conventional heaters of comparable size. The heater furthermore operated at a lower operating temperature and with a lower current.

Other tests performed also demonstrate that operation of the heater of the present invention requires an alternating current type power source and that any significant deviation from the dimensional tuning relationships aforementioned render the heater opertionally ineffective.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIG. 1 is a perspective view of a typical heater constructed in accordance with the present invention.

FIG. 4 is a transverse section view taken substantially through a plane indicated by a section line 4—4 in FIG. 2.

FIG. 5 is a simplified partial side section view denoting various critical dimensional relationships of the heater.

DETAILED DESCRIPTION OF PREFERRED EMBODIMENT

Figure 2:
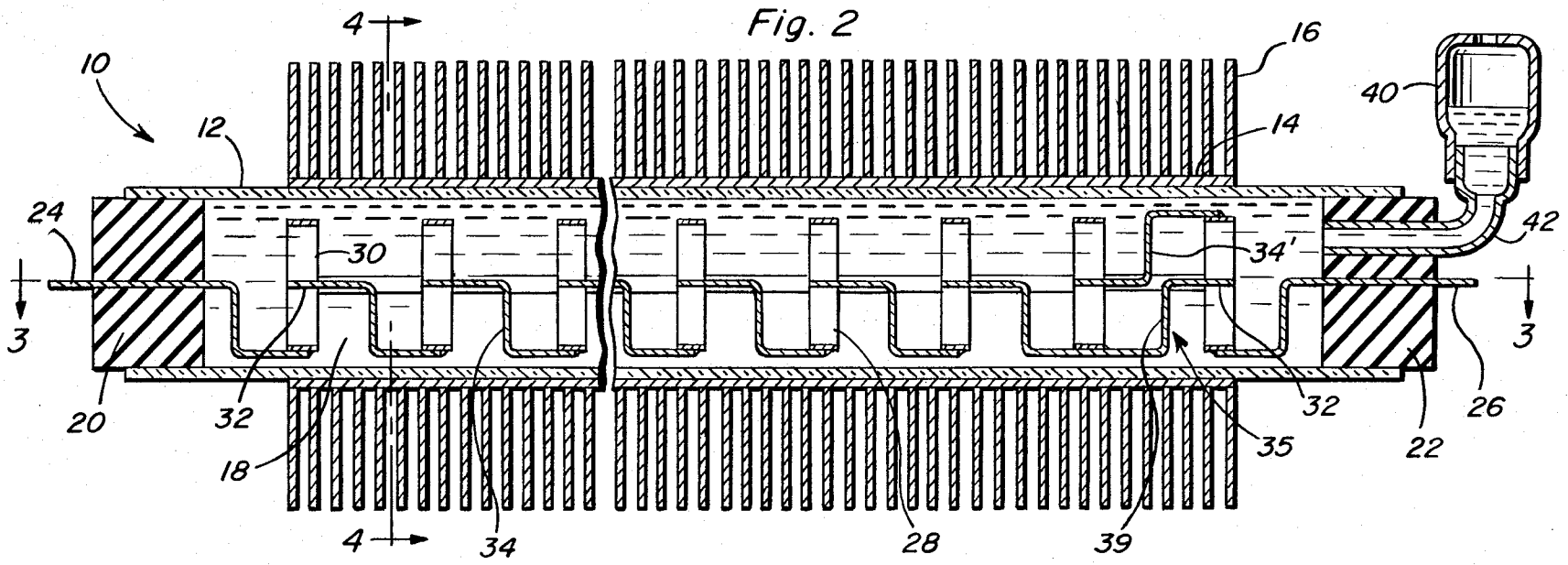
FIG. 2 is a partial side section view taken substantially through a plane indicated by section line 2—2 in FIG. 1.

Referring now to the drawings in detail, FIGS. 1-4 illustrate an electrical heater generally denoted by reference numeral 10, constructed in accordance with one embodiment of the invention. The heater includes an axially elongated container 12 that is cylindrical in shape and made of glass or some other suitable material that is electrically non-conductive. The container 12 extends through a heat conductive sleeve 14 from which closely spaced fins 16 project for heat radiating purposes. A body of liquid 18 is confined within the container to form an electrically conductive medium through which current is conducted. The container is therefore closed at opposite axial ends by stoppers 20 and 22 made of an electrically non-conductive material such as plastic. Electrical power terminal leads 24 and 26 extend through the stopper for connection to an external source of electrical energy. Internally of the container 12, the leads 24 and 26 are connected to an electrode assembly generally referred to by reference numeral 28.

In the illustrated embodiment, the electrode assembly is formed by a plurality of plate electrodes 30 and an equal number of grid electrodes 32. The plate electrodes are thin annular elements coaxially aligned with the longitudinal axis of the cylindrical container 12 within which they are disposed in equal, axial spaced relationship to each other. The grid electrodes 32 are wire sections disposed along the longitudinal axis centrally within the annular plate elements 30 from which they are radially spaced. Each of the grid wire sections 32 is supported by a connecting wire extension 34 having two right angle bends, each wire extension being welded externally to an annular plate element of a following electrode pair 30–32. Thus, the electrode assembly 28 is formed by series connected pairs of plate and grid electrodes, with electrical current path sections extending through the body of liquid between the radially spaced plate and grid electrode elements. The annular plate electrode elements at the axial ends of the electrode assembly are electrically connected to the power terminal leads 24 and 26 as shown in FIG. 2. Further, a balun type arrangement 35 interconnects the last two plate and grid pairs of the electrode assembly adjacent the end power terminal lead 26 in order to obtain antenna match between the voltage input and the current path established by the electrode assembly and the body of the liquid. The balun is formed by wire element 39 interconnecting the next to last plate with the end grid.

Figure 3:
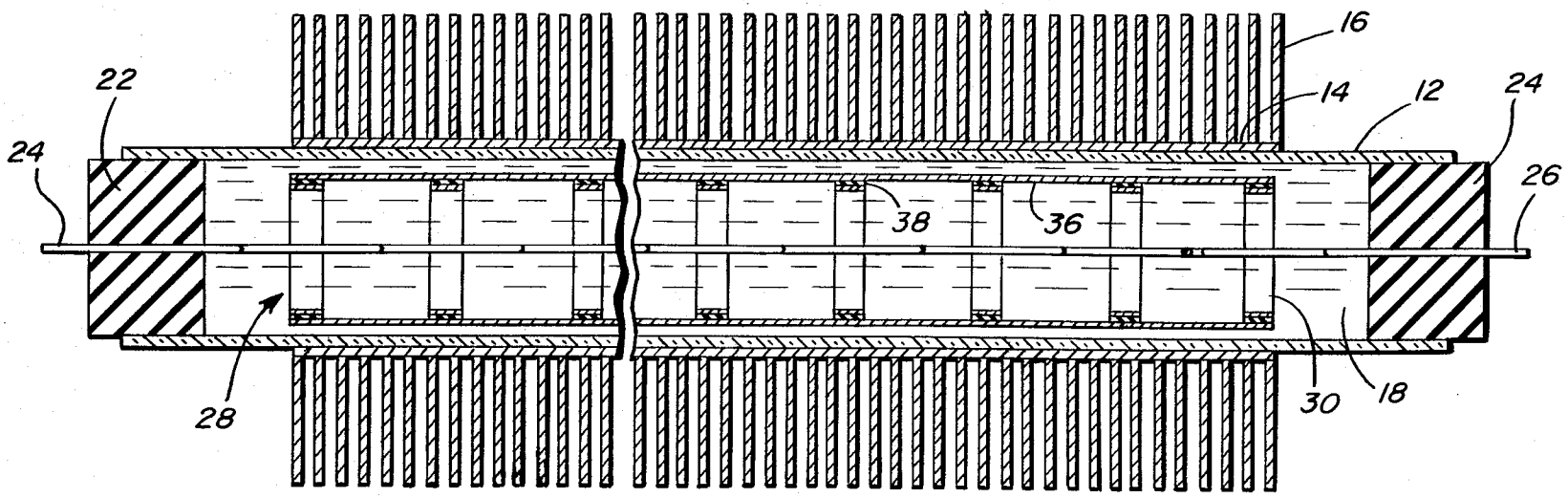
FIG. 3 is a partial section view taken substantially through a plane indicated by section line 3—3 in FIG. 2.

As more clearly seen in FIG. 3, the annular plate electrode elements 30 are held assembled in axially spaced relationship to each other by rods 36 to which the elements 30 are adhesively secured through non-conductive spacers 38. The electrode assembly is dimensioned to just fit within the cylindrical container 12 completely immersed within the body of liquid 18. The liquid will completely fill the internal volume of the container at its operating temperature. To insure such complete filling of the container with the liquid and provide for its thermal expansion, a reservoir 40 is provided as shown in FIGS. 1 and 2. A liquid overflow tube 42 extends from the reservoir through the stopper 22 into the container 12 so that excess liquid will enter the reservoir due to thermal expansion when the liquid is heated to the operating temperature.

In accordance with the present invention, the electrical energy supplied to the heater 10 is necessarily of the alternating current (AC) type, such as the generally available 60 cycle, AC voltage power source diagrammed in FIG. 5. The AC operating voltage for the heater is applied by the power terminal leads 24 and 26 across feeder end points of the electrode assembly, the feeder end points being fixedly spaced a distance ($L_\lambda$) as denoted in FIG. 5 constituting the total length of a current path through the body of liquid. For the particular electrode assembly 28 hereinbefore described, the distance ($L_{80}$) will be one of the dimensional factors dictating the radial plate to grid spacing forming sections of the conductive path as aforementioned. The other factors will be the diameter ($D_G$) of the wire grids 32, the diameter (Dp) of the plate 30, the thickness (Tp) of the plate and the number (N) of electrode (plate-grid) pairs in the electrode assembly. The spacing (S) between electrode pairs will depend on the width (W) of the plates 30 and the number (N) for a given path length ($L_\lambda$).

The plate width (W) will depend on the electrical resistance of the path which in turn depends on the liquid selected. In the illustrated embodiment, the liquid is water exhibiting a total path resistance of 338 ohms at the operating temperature close to its boiling point of 212° F. Other liquids for use in accordance with the present invention are contemplated, such as anti-freeze solutions, DMSO, high resistance mineral oils and other high density oil base liquids.

The path length ($L_\lambda$) and the dimensional relationships of the electrode assembly 28 dependent thereon are tuned to establish a resonance relationship between the alternating frequency of the AC voltage source and a radio frequency band containing a harmonic of such alternating frequency at which electromagnetic wave energy is effectively radiated. Such resonance relationship corresponds to that established by a half-wave dipole antenna in free space having a single wire length, corrected for end effects.

As is well known in the art, dipole antenna lengths are based on the formula $\lambda = \nu/f$, where ($\lambda$) is the wavelength of electromagnetic wave energy propagated through free space at a velocity ($\nu$) of 492 ft. per second at a frequency (f) in terms of MHz. The half-wavelength upon which the dipole antenna length is based, while theoretically equal to 492 ft. per second, per MHz of wave frequency, is however reduced to 468 ft. to compensate for end effects in accordance with practice in the antenna art. Thus based on such antenna theory, a single wire, dipole antenna may be dimensionally tuned to a given radio frequency.

In accordance with the present invention, it has been found that the lowest effective radio frequency band embracing a harmonic of 60 cycles per second, has a fundamental frequency of 223.5 MHz which is in resonance with a single wire dipole antenna having a minimum quarter-wave length of approximately 12 inches. Thus, for a 60 cycle power source, the dimensionally smallest heater 10 utilizing water as the liquid conducting medium has the following tuned dimensions with reference to FIG. 5:

$L_\lambda = 12$ inches (minimum length)
$W = 11/64$ inch
$S = \frac{3}{4}$ inch
$Dp = \frac{3}{4}$ inch
$D_G = 1/6$ inch (No. 14 wire)
$Tp = 1/64$ inch
$N = 15$ (number of electrode pairs)

Heaters having tuned path lengths that are multiples of the minimum length may be provided in accordance with the present invention. Such longer heaters will have a larger number of electrode pairs with closer spacing to maintain the critical tuning parameters. Higher gain and heating efficiency is expected for such longer heaters.

Actual tests performed with the heater 10 as hereinbefore described, indicate that it will not operate when a DC voltage is applied, demonstrating that operation of the present invention is not based on the conventional resistance heating principle. Further, a heater having a current path length substantially deviating from the 12 inch length or multiples thereof was found to be ineffective. Only a heater dimensionally tuned as herein described, was found to be fully operative when a 60 cycle AC voltage is applied to cause heating of the liquid and a reduction in its resistance from a cold value to 338 ohms during a start-up period as the liquid temperature rises toward an equilibrium operating level. During the operating phase, performance measurements of the heater 10 indicate a heating rate of 1700 BTU per hour under an AC voltage of 110 volts. Current consumption also rises during the start-up period to a maximum level of 355 ma. Thus, the heater 10 operates at a higher BTU rating and at a lower temperature and lower current than conventional resistance heaters of comparable size, such as a 14 inch, continuous coil heater having a $\frac{1}{8}$ inch, ceramic coated coil diameter.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a source of electrical energy having a relatively low pulsating frequency, an electrical heater, comprising an elongated container, a body of liquid confined to the container, electrode means mounted in the container for establishing an electrical current path within the body of liquid from which heat is evolved, and power terminal means connecting the source to the electrode means at fixedly spaced feeder end points between which the path extends for establising resonance conditions under which electromagnetic waves are propagated within a frequency band having a relatively high fundamental frequency that is a harmonic of the relaively low frequency of the source to generate said heat within the body of liquid.

2. The combination of claim 1 wherein said current path has a minimum length corresponding to a quarter wavelength dipole antenna from which energy is radiated at the fundamental frequecy of 223.5 MHz, where the frequency of the source is 60 Hz.

3. In combination with an AC source of electrical energy having a predetermined alternating frequency, an electrical heater, comprising an elongated container, a body of liquid confined to the container, electrode means mounted in the container for establishing an electrical current path within the body of liquid, and power terminal means connecting the source to the electrode means at fixedly spaced feeder end points between which the path extends for establishing resonance conditions under which electromagnetic waves are propagated within a radio frequency band having a relatively high fundamental frequency that is a harmonic of the frequency of the source, said current path between the feeder end points having a minimum length of 12 inches corresponding to a quarter wavelength dipole antenna from which energy is radiated at the fundamental frequency of 223.5 MHz, where the frequency of the source is 60 Hz.

4. The combination of claim 3 wherein the length of said electrical current path between the feeder end points is reduced to compensate for end effects.

5. The combination of claim 4 wherein said liquid is water having a total resistance of 338 ohms at an operating temperature of the heater.

6. The combination of claim 5 including reservoir means connected to the container for storing the liquid in excess of the volume of the container when heated to said operating temperature.

7. The combination of claim 4 wherein said liquid is water having a total resistance of 338 ohms at said operating temperature of the heater.

8. In combination with an AC source of electrical energy having a predetermined alternating frequency, an electrical heater, comprising an elongated container, a body of liquid confined to the container, electrode means mounted in the container for establishing an electrical current path within the body of liquid, and power terminal means connecting the source to the electrode means at fixedly spaced feeder end points between which the payth extends for establishing resonance conditions under which electromagnetic waves are propagated within a radio frequency band having a fundamental frequency that is a harmonic of the frequency of the source, and reservoir means connected to the container for storing the liquid in excess of the volume of the container when heated to an operating temperature.

9. In combination with an AC source of electrical energy having a predetermined alternating frequency, an electrical heater, comprising an elongated container, a body of liquid confined to the container, electrode means mounted in the container for establishing an electrical current path within the body of liquid, and power terminal means connecting the source to the electrode means at fixedly spaced feeder end points between which the path extends for establishing resonance conditions under which electromagnetc waves are propagated within a radio frequency band having a fundamental frequency that is a harmonic of the alternating frequency of the source, said electrode means comprising a plurality of plate electrodes, a plurality of grid electrodes equal in number to the plate electrodes, and means fixedly spacing the plate and grid electrodes from each other for establishing sections of the current path therebetween.

10. The combination of claim 9 wherein said plate electrodes are annular elements spaced from each other in axial alignment with a longitudinal axis of the container, and said grid electrodes are wire elements axially spaced along the axis in radially spaced relation to the annular elements.

11. An electrical heater, comprising an axially elongated container, a body of liquid confined to the container, electrode means for establishing an electrical current path through the body of liquid, and means mounting the electrode means within the container for limiting said current path to a length of a dipole antenna functioning to effectively radiate energy.

12. The combination of claim 11 wherein the length of said current path has a minimum resonance value corresponding to a quarter wavelength dipole antenna.

13. The combination of claim 12 wherein said minimum resonance value is 12 inches.

14. The combination of claim 11 wherein said energy is effectively radiated at a radio frequency that is a harmonic of 60 Hz.

15. In an electrical heating system including an electrical medium, power terminal means for conducting current through the medium along a predetermined path to generate heat, and heat conductive means for radiating the heat from the medium, the improvement comprising a source of voltage connected to the power terminal means supplying said current at an alternating frequency, and electrode means connected to the power terminal means for limiting said path to that of a dipole antenna length functioning to effectively radiate energy at a fundamental radio frequency that is a harmonic of the alternating frequency of the voltage source.

16. The improvement as defined in claim 15 wherein said path is established between fixedly spaced feeder end points of the power terminal means across which the voltage source is applied.

17. The improvement as defined in claim 16 wherein said medium is a confined body of liquid.

18. The improvement as defined in claim 17 wherein said path has a length equal to a multiple of 12 inches.

19. The improvement as defined in claim 18 wherein said power terminal means includes a pair of end feeder leads to which the voltage source is connected, and antenna matching means interconnecting the feeder leads to the electrode means.

20. The improvement as defined in claim 15 wherein said power terminal means includes a pair of end feeder leads to which the voltage source is connected, and antenna matching means interconnecting the feeder leads to the electrode means.

* * * * *